US005163494A

United States Patent [19]

MacNeil et al.

[11] Patent Number: 5,163,494

[45] Date of Patent: Nov. 17, 1992

[54] SECTIONAL DOOR INSTALLATION

[76] Inventors: Daniel J. MacNeil; Vincent A. MacNeil, both of P.O. Box 1057, Barrie, Ontario, Canada, L4M 5E1; Richard E. Piper; Edward F. Piper, both of 85 St. Peter Street, Lindsay, Ontario, Canada, K9V 5E3

[21] Appl. No.: 640,464

[22] Filed: Jan. 11, 1991

[51] Int. Cl.[5] ..... E05D 15/00

[52] U.S. Cl. ..... 160/201; 160/188; 160/205; 160/236

[58] Field of Search ..... 160/201, 202, 205, 207, 160/220, 232, 236, 188, 189, 136, 138, 139, 150, 159, 160, 84.2, 84.3, 32, 36

[56] References Cited

U.S. PATENT DOCUMENTS

| | | | |
|---|---|---|---|
| 1,708,636 | 4/1929 | Shook | 160/150 |
| 1,892,340 | 12/1932 | Guth | 160/205 X |
| 2,621,723 | 12/1952 | Elten | 160/201 X |
| 2,688,365 | 9/1954 | Garubo | 160/201 |
| 3,008,519 | 11/1961 | Hawkins | 160/176.1 X |
| 3,151,665 | 10/1964 | Stack . | |
| 3,401,734 | 9/1968 | McCabe . | |
| 3,424,222 | 1/1969 | Stoner et al. | 160/201 X |
| 3,462,881 | 8/1969 | Lynn et al. . | |
| 3,853,169 | 12/1974 | Music et al. . | |
| 4,269,253 | 5/1981 | Ziegler | 160/201 |
| 4,427,049 | 1/1984 | Belanger et al. . | |
| 4,537,237 | 8/1985 | Sepulveda et al. . | |
| 4,676,293 | 6/1987 | Hanssen | 160/201 |
| 4,846,244 | 7/1989 | Rosenfeld | 160/201 |
| 4,846,245 | 7/1989 | Pagliaro et al. . | |
| 5,056,579 | 10/1991 | Krafutler . | |

FOREIGN PATENT DOCUMENTS

| | | |
|---|---|---|
| 88238 | 6/1904 | Canada . |
| 159707 | 12/1922 | Canada . |
| 163471 | 6/1929 | Canada . |
| 332121 | 9/1932 | Canada . |
| 554502 | 3/1958 | Canada . |
| 0033199 | 8/1981 | European Pat. Off. . |
| 0320350 | 6/1989 | European Pat. Off. . |
| 871910 | 7/1961 | United Kingdom . |

*Primary Examiner*—David M. Purol

*Attorney, Agent, or Firm*—Lowe, Price, LeBlanc & Becker

[57] ABSTRACT

A sectional door installation comprises a series of horizontal door panels mounted on opposite ends on scissors linkages to move between a deployed generally vertical position closing the doorway to a withdrawn position wherein the panels are arranged generally horizontally at the upper end of the doorway. The panels are transparent and are detachably connected to the scissors mechanism at their opposite ends so that they can readily disengage therefrom when impacted by an object such as an automobile, without damaging the object or themselves being damaged.

24 Claims, 4 Drawing Sheets

SECTIONAL DOOR INSTALLATION

BACKGROUND OF THE INVENTION a) Field of the Invention

This invention relates to a new or improved sectional door structure and to a novel door panel for use therein. The specific embodiment of door structure disclosed herein is designed as a wind door for use in an automatic car wash, but clearly it would be adaptable for use in numerous applications wherein a reliable rapidly operating door structure is required.

b) Description of the Prior Art

Particularly in extremely cold climates, it is desirable to provide in an automatic car wash both entry end and exit end wind doors which will open and close rapidly to permit passage of cars through the doorways, but otherwise will present a substantial barrier to the entry of large volumes of extremely cold atmospheric air which would cause serious problems if it were to bring about freezing of the numerous water pipes and nozzles in the car wash. Such a wind door must be designed to be safe and reliable in operation and should be of such a nature that it will not damage an automobile should it accidentally come into contact with one. Furthermore, for safety reasons a wind door should be substantially transparent.

In one known form of wind door commonly used in automatic car washes, there is a series of vertically elongated rectangular strips of clear plastic material, each supported at its upper end in a carrier that can rotate about a vertical axis and can be moved longitudinally in a guide, spanning the top of the doorway. In the closed condition the carriers are spaced uniformly along the guide rail and are oriented such that the panels are essentially complanar and slightly overlapping, thus forming a substantially continuous door structure. In the wind door at the exit end of the car wash, the lower ends of the panels are sometimes provided with a covering of heavy felt material, the panels being substantially flexible so that when they are in the closed position, an automobile can pass through the doorway and exit the car wash, the lower ends of the panels being displaced to accommodate this, and in the process the felt material thereon wiping across the surfaces of the automobile and serving to remove excess moisture.

A significant problem with doors of the above described kind is that they do not form a very efficient seal since the lower ends of the panels are unconnected, and therefore the panels can flap about quite freely in response to gusts of air, thus creating significant openings through which cold air can enter the car wash. Additionally, because of their flexibility and unrestrained swinging action, the separate panel sections often clash together so that although originally of substantially clear material, their transparency is gradually degraded over time until eventually they become merely translucent.

SUMMARY OF THE INVENTION

The aim of the present invention is to provide a sectional door structure that will overcome at least some of the problems that have been encountered with some of the structures of the prior art.

The invention provides a panel for use in a sectional door installation, said panel being configured at each end to form a projection-and-socket attachment with a mounting means on a door operating mechanism, said panel having flexibility sufficient to disengage from said mounting means when subjected to a bending moment of predetermined magnitude, while being stiff enough that its deflection under the force of gravity when oriented horizontally is not of sufficient magnitude as to disengage said attachment.

The invention also provides a sectional door comprising: a series of horizontal door panels each being connected at its opposite ends to an operating mechanism by means of which the door panels can be moved between a deployed condition, wherein they close a doorway, and a withdrawn condition, wherein the doorway is open, said operating mechanism comprising:

a pair of parallel vertical guideways for installation at opposite sides of the doorway and each having a series of mountings movable therealong;

each said door panel being generally planar, and having each of its opposite ends supported in a mounting of a corresponding one of said series, in the deployed condition said panels being arrayed in contiguous generally upright orientation whereas in the retracted condition said panels are withdrawn into closely adjacent inclined orientation at the top of said doorway;

each of said panels being detachably connected to its mountings so that when the doorway is partially or fully closed a panel can readily be displaced relative to its mountings when subjected to obstruction, or to loading of predetermined magnitude.

Each panel end may be connected to its associated mounting by an interengaging projection-and-socket connection, with the panel having sufficient longitudinal flexibility that under a predetermined force applied to a central region of the panel it will deflect sufficiently to disengage from its mounting. The panel however has sufficient stiffness that the deflection produced under its own weight when it is turned to the horizontal position will not effect the disengagement from the mounting.

Preferably the operating mechanism comprises a pair of scissors linkages, one being arranged in association with each guideway, and the panels being mounted on the scissors linkage to be moved longitudinally and rotationally therewith. The panel mountings may comprise projections on the scissors linkage engaging respective downwardly open sockets in the panel ends so that a panel can be disengaged from the projections simply by being moved in a direction parallel to the plane of, and at right angles to the length of the panel. However when the panels approach the closed position, they overlap so that they cannot be disengaged in this way. Nevertheless the structure is preferably so designed as to accomodate at least a limited displacement of the panels in the plane of the doorway when they approach the fully closed condition, so that they can yield sufficiently to accommodate a minor obstruction at the lower side of the doorway.

Preferably each guideway is formed by vertical channel beams arranged back-to-back to define a slot therebetween through which central pivot joints of the scissors linkage are guided to move vertically. A transverse shaft spanning the upper side of the doorway is driven by a motor and has at each end a sprocket wheel driving a chain forming a loop in which is connected a bracket attached to the lower end of the scissors linkage so that rotation of the shaft in one direction or the other will serve to extend or retract the scissors linkages to close or open the door respectively.

The door panels are preferably fabricated in a clear plastics material such as polycarbonate, and because they are of substantial length to accomodate a wide doorway, the panels include reinforcing bars or the like to support them so that their central areas do not sag excessively when the door is open. The connection between the ends of each panel and the respective scissors linkage is such as to permit the panel to be deflected and disengaged from the associated linkage to avoid damaging an automobile or other object that might inadvertently come into contact with the panel.

BRIEF DESCRIPTION OF THE DRAWINGS

The invention will further be described, by way of example only, with reference to the accompanying drawings, wherein.

DESCRIPTION OF THE PREFERRED EMBODIMENT

Figure 1:
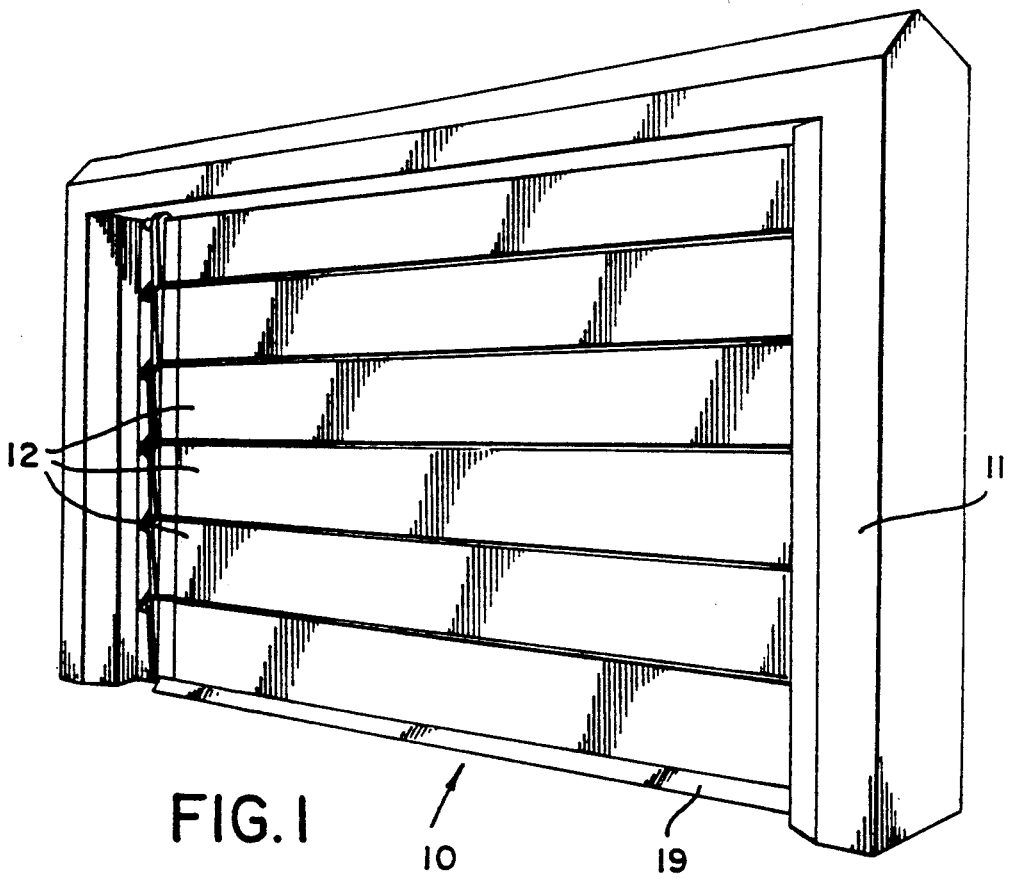
FIG. 1 is a generally schematic perspective outside view of a preferred embodiment of a sectional door, the door being shown in the closed condition.
Figure 2:
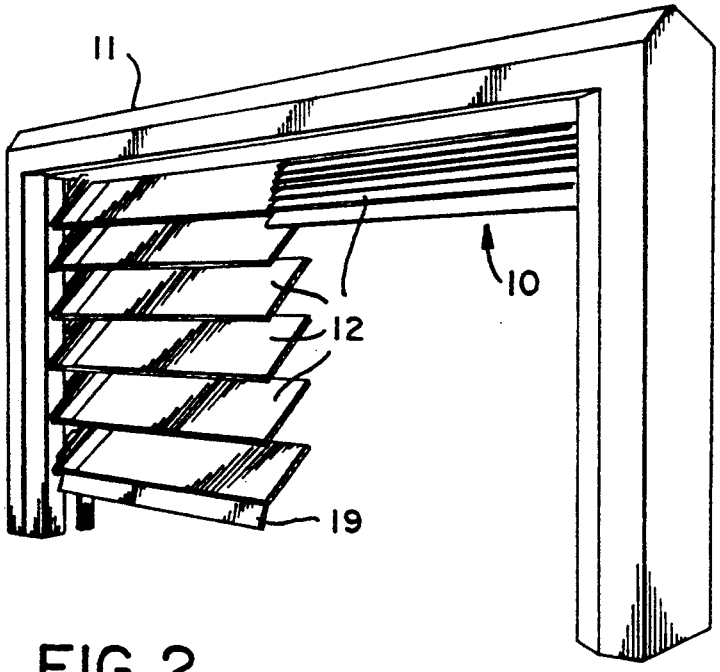
FIG. 2 is a view similar to FIG. 1 showing the door in both partially and fully open conditions.
Figure 3:
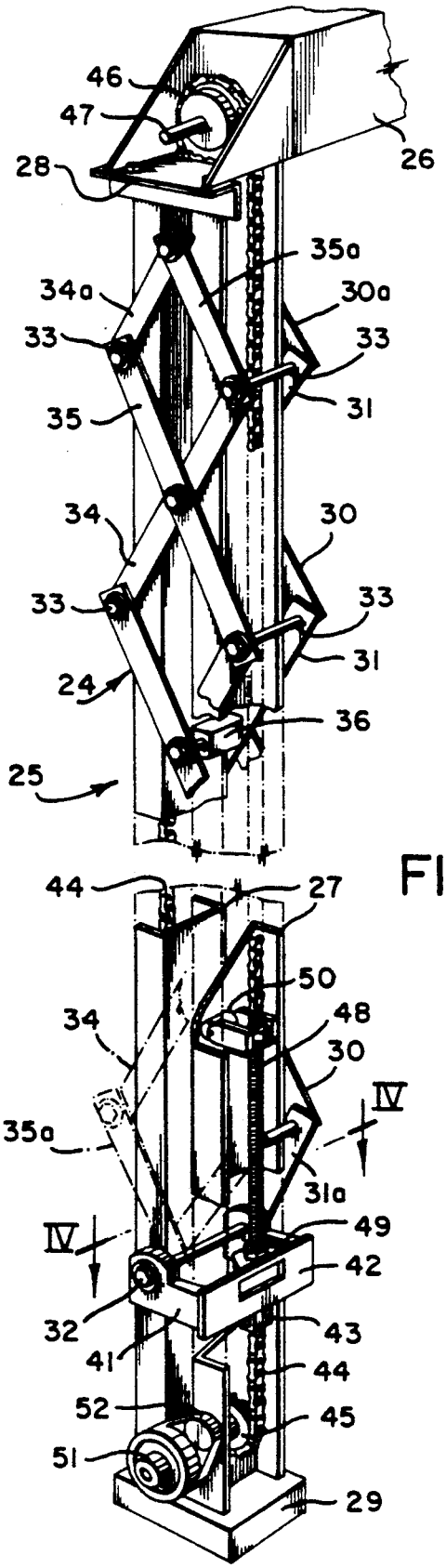
FIG. 3 is a fragmentary partially sectioned perspective view showing one side of the door and its operating mechanism.

As seen in FIGS. 1 and 2, a sectional door structure is positioned within a doorway defined by a frame 11 and comprises a series of horizontally arranged door panels 12 mounted on an operating mechanism 13 (see FIG. 3). By means of the operating mechanism the door panels can be moved from the deployed condition as seen in FIG. 1 wherein they are arranged in generally vertical overlapping orientatio, and the withdrawn position as shown in the right hand part of FIG. 2 wherein the panels 12 are stacked closely adjacent one another in the upper region of the doorway and in substantially horizontal orientation. FIG. 2 shows in the left hand part thereof an intermediate position of the panels as they are moved from the door closed to the door open position.

Figure 6:
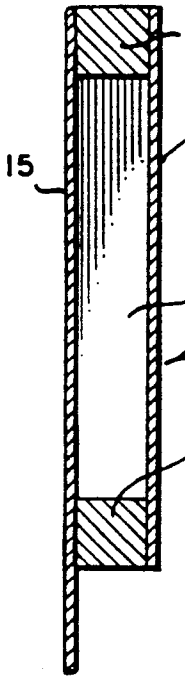
FIG. 6 is a sectional view of a door panel taken on the line VI—VI in FIG. 4.
Figure 7:
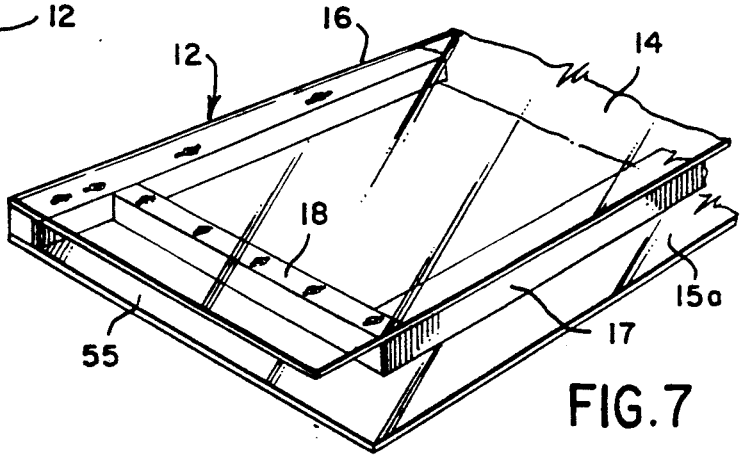
FIG. 7 is a fragmentary perspective view of an end portion of the door panel.
Figure 8:
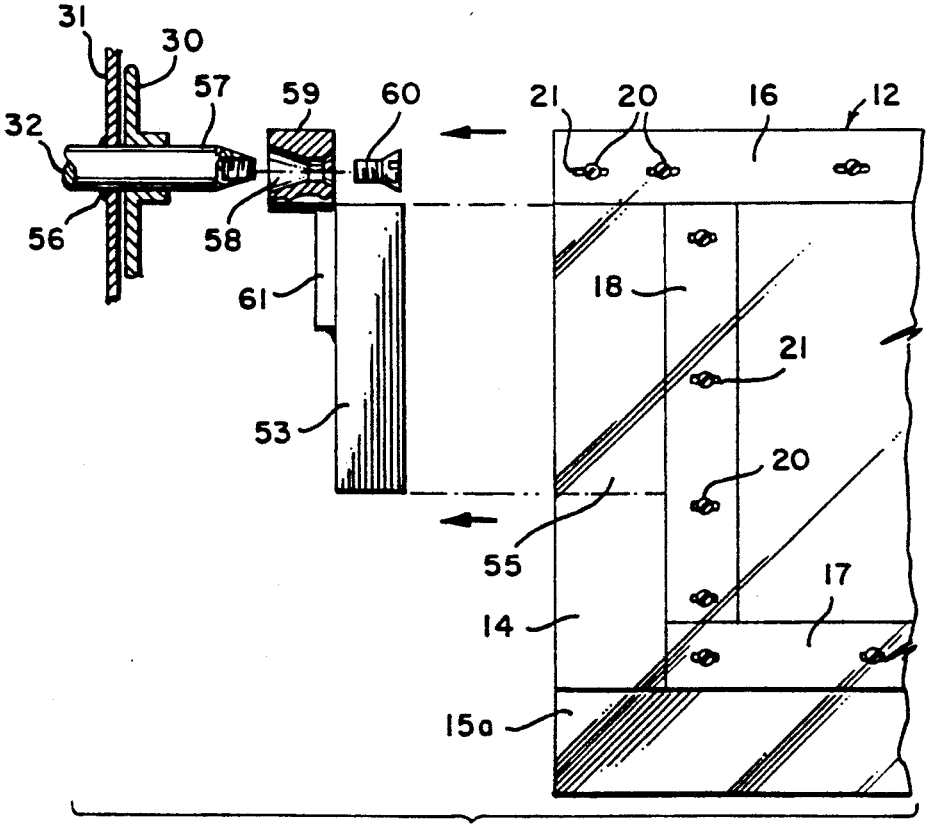
FIG. 8 is a partial exploded view that illustrates the means of attachment of the ends of a door panel to the respective scissors linkage operating mechanism.

The structure of the door panels 12 is more clearly shown in FIGS. 6, 7 and 8. Each panel is of elongated rectangular form, and comprises spaced inner and outer sheets 14, 15 respectively, of transparent polycarbonate plastics material. The sheets are spaced on opposite sides of and are secured to a reinforcing structure formed by longitudinally extending upper and lower rectangular glass fibre rods 16, 17 which are spanned by perpendicularly arranged glass fibre struts 18 spaced at suitable intervals in the length of the panel. As best seen in FIGS. 6 and 7, the outer sheet 15 projects below the lower rod 17 so that when the panels are deployed in the closed condition, the lower portion 15*a* of the outer sheet will overlap the upper end of the adjacent lower panel 12. However in the lowermost of the panels 12, the outer sheet 15 terminates at the lower edge of the lower rod 17, there being a flexible sealing strip 19 extending along this lower edge as seen in FIGS. 1 and 2.

The doorway may be of any convenient width, the one illustrated in the drawings being designed for installation in an automatic car wash, and accordingly having a width of approximately ten feet. The polycarbonate sheets 14 and 15 are attached to the reinforcing rods by any suitable means, e.g. threaded fasteners 20. Since polycarbonate and glass fibre have substantially different coefficients of expansion, the fasteners 20 have enlarged heads and narrower stems that pass through elongate slots 21 in the sheets 14 and 15 to permit differential expansion of these sheets and the rods 16 and 17.

As noted, the panels 12 have a length of about ten feet, the doorway having a height of about eight feet, so that in a door construction having six panels as shown, the panels have a height of about sixteen inches. The polycarbonate sheets 14, 15 have a thickness of between 0.125 and 0.93 inches, the glass fibre rods having a section that is one inch square. With this construction, the panels 12 while retaining a measure of flexibility, do not sag sufficiently under their own weight when in the horizontal position as seen in the right hand portion of FIG. 2 to become disengaged from the operating mechanism, as will now be more fully described.

Figure 4:
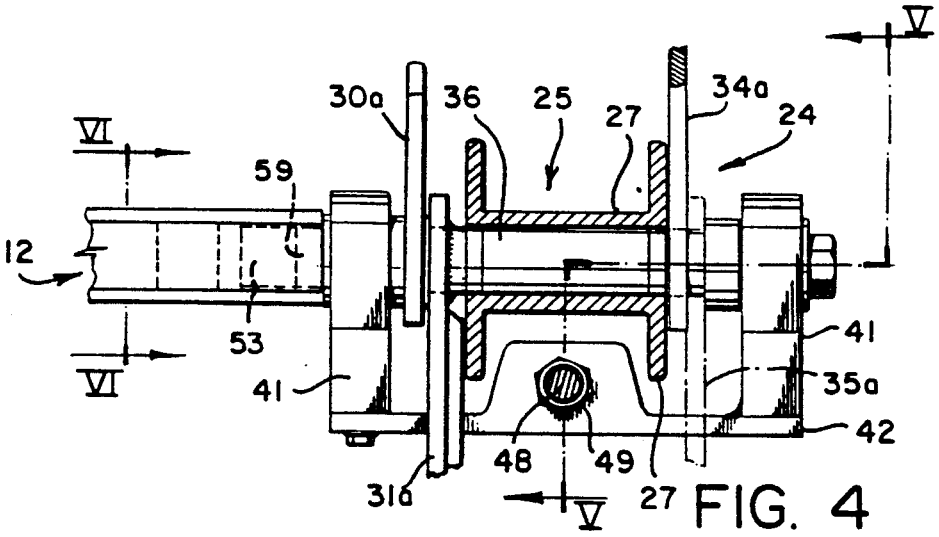
FIG. 4 is a horizontal sectional view taken on the line IV—IV in FIG. 3.

As seen in FIG. 3, on each side of the doorway there is a vertical post structure 25, there being a transverse horizontal box-section head beam 26 supported between the posts 25. Each post comprises a pair of massive channel members 27 arranged in back-to-back relationship with their opposed web surfaces confronting as best seen in FIG. 4, the channel members being secured in this relationship by attachment at their opposite ends to a rigid head plate 28 and base plate 29.

The operating mechanism 13 for the door is guided for vertical movement with respect to the vertical posts 25 and comprises on each side of the doorway a compound scissors structure 24 to which the ends of the door panels 12 are attached. More specifically, each scissor structure 24 comprises on the inboard side of each vertical post structure 25 first and second series of links 30, 31 which are pivotally interconnected at their midpoints on pivot axes 32 and are successively pivotally interconnected at their ends on pivot axes 33.

On the outboard side of each vertical post structure 25 are third and fourth series of links 34, 35 corresponding respectively to said second and first series of links and likewise interconnected pivotally on the axes 32 and 33. The terminal links 30*a*, 31*a*, 34*a* and 35*a* are of only half the length of the intermediate links 30, 31, 34, 35 since they terminate at the upper and lowermost of the pivot axes 32. The uppermost pivot axes 32 is essentially fixed relative to the vertical post 25, whereas the other pivot axes 32 are vertically movable therein, being guided by low friction sliding blocks 36 that are in sliding contact with the vertically extending engagement surfaces defined by the webs of the channel members 27.

The lowermost of the pivot pins 32 extends through spaced bearing lugs 41 in a U-shaped bracket 42. The underside of the bracket 42 defines a mounting 43 for the attachment of one end of a flexible chain 44, the chain extending over a sprocket 45 journalled to rotate in the lower end of the post structure 25, and extending upwardly between the flanges of the channel member 27 to pass over a top sprocket 46 which is fixed to rotate with a shaft 47 that is journalled in the head beam 26. The chain 44 extends downwardly from the sprocket 46 and is connected to the upper end of a screw threaded shaft 48, the lower end of which is attached to the bracket 42 by an adjustable fastening 49 by means of which the position of the threaded shaft may be adjusted vertically with respect to the bracket 42. The shaft 48 is thus movable vertically with the bracket 42, and carries on its upper end a small guide roller 50 which engages the central part of the associated channel member 27.

The bottom sprocket 45 is mounted to be rotated by a drive motor 51 which includes a belt drive 52 to the shaft of the sprocket 45. It will be appreciated that rotation of the sprocket 45 is effective to raise or lower the bracket 42 and with it the associated pivot axis 32. By virtue of the scissors linkages, each of the other pivot axes 32 will be constrained to move vertically proportionately to the movement of the bracket 42, and that such movement will be controlled by the scissors linkages 30, 31 and 34, 35.

As mentioned above, the scissors linkage control mechanism shown in FIG. 3 is replicated on the post structure 25 on the opposite side of the door, so that rotation of the shaft 47 will ensure that both scissors mechanism are controlled to operate in unison.

As mentioned above, the panels 12 are attached to the operating mechanism 13 at each end by a projection and socket attachment. The panels have enough flexibility that when in the closed position they can be deformed and deflected to an extent sufficient to disengage from the operating mechanism when a sufficiently large bending load is applied to a panel e.g. as by impact by an automobile when the panel is in the door closed condition.

Figure 5:
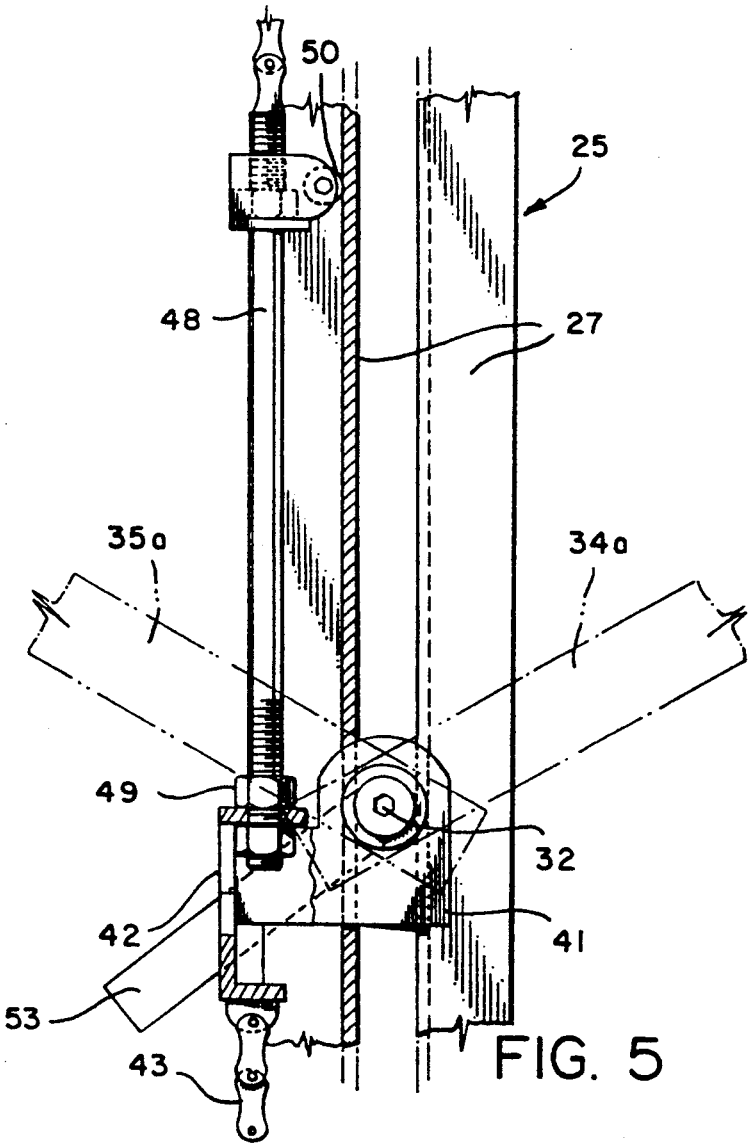
FIG. 5 is a fragmentary vertical sectional view of one side of the door operating mechanism taken on the line V—V in FIG. 4.

As seen in FIGS. 4 and 5, the opposite ends of each panel 12 are carried on projections 53 on the associated first series of links 30, these projections each extending into the socket provided by the recess 55 formed between the ends of outer and inner polycarbonate sheets 15 and 14 as best seen in FIGS. 7 and 8. The projections 53 are substantially loosely received in the recesses 55, and project into the recesses by a distance of about one inch.

The attachment of the projections 53 to their respective scissors linkage is best shown in FIG. 8. Each second link 31 in the scissors linkage is welded as at 56 to the associated pivot axis pin 32. The pin 32 has a tapered end 57 projecting laterally inwardly of the doorway and adapted to receive the tapered bore 58 of a bracket 59 and to be rigidly secured thereto by a threaded fastener 60 in engagement with the end of the pin 32. A radial arm 61 on the bracket 59 has fixed to it the projection 53, this being in the form of an elongate one inch square fiberglass rod. From the foregoing description it will be clear that in the installed condition the projection 53 is fixed rigidly with respect to the second link 31 to rotate therewith, and will follow the rotational motions of the latter as the scissors linkage is extended. In the mounted condition the upper reinforcing rod 16 is aligned with the pin 32, and its outer end rests upon the upper end of the projection 53 to support the weight on the panel thereon.

It will be noted that the recess 55 in the panel end is open both laterally and downwardly, and has a length that exceeds the length of the projection 53 by a substantial amount, e.g. five or six inches. Throughout the range of the opening movement of the door, except at or near the fully closed position, the panels 12 can be removed without deformation, simply by sliding them parallel to their planes at right angles to their lengths so that the projections 53 pass through the open lower ends of the recesses 55. When the panels are in overlapping registration at or near the closed position of the door however they cannot be removed in this manner, but nonetheless the lost motion afforded by the difference in length between the recesses 55 and the projections 53 means that each panel can be displaced by this distance, provided that the panels above it can likewise be displaced. Thus, an obstruction on the still of the doorway will not damage the components of the door. If the obstruction is of a height greater than about five or six inches, the panels, commencing with the lower most one, will successively be slid out of engagement with their projections 53 as they are lowered into contact with the obstruction by the operating mechanism. This is the situation that would develop if an obstacle such as a car was positioned in the doorway when the operating mechanism was actuated to close the door. Once disengaged from their mountings, the panels would fall freely to the floor, and accordingly should preferably be of sufficiently robust construction that this will not damage them.

If the door is closed on an obstacle that is less than five or six inches in height, then downward movement of the lower most of the panels 12 will be halted by engagement with the obstacle. However because of the lost motion provided between the projection 53 and the recess 55 at each end of each door panel, the operating mechanism can continue to move to the fully deployed position, while the stacked door panels 12 are held away from the fully closed position by engagement with the obstacle.

The door is also designed to allow for disengagement of the panel 12 from the operating mechanism without damage to either, should an automobile or the like inadvertently be driven into the door. With the configuration shown, the end of a panel 12 will disengage from the projections 53, when the central area of the panel has been deflected by an amount of about eight inches. This is well within the resilient capability of the panel materials in normal operating temperatures.

As mentioned, the flexibility of the panels must not be such that the deflection produced in the panels by the force of gravity when the panels are rotated to the horizontal position is sufficient to cause such disengagement. With the structure as shown, the maximum deflection of the panels 12 under their own weight in the horizontal position amounts to no more than two inches.

The door mechanism described is designed to operate smoothly and reliably over a large number of opening and closing cycles without significant maintenance or wear. The configuration of the double scissors linkages embracing each of the vertical posts 25 gives the mechanism a strength and robustness, and a particular resistance to bending moments which might be applied thereto upon impact of an automobile or the like on the door. In the latter case, the door panels 12 will merely be carried away, and the effect upon the operating mechanism is insignificant.

The links 34 and 31 which are adjacent the flanges of the channel members 27 are preferably in sliding engagement therewith and are provided with a coating or padding of low friction material to facilitate sliding movement.

I claim:

1. A sectional door comprising:

a series of horizontal door panels each being connected at its opposite ends to an operating mechanism by means of which the door panels can be moved between a deployed condition, wherein they close a doorway, and a withdrawn condition, wherein the doorway is open, said operating mechanism comprising:

a pair of parallel vertical guideways for installation at opposite sides of the doorway and each having a series of mountings movable therealong;

each said door panel being generally planar, and having each of its opposite ends supported in a mounting of a corresponding one of said series, in the deployed condition said panels being arrayed in contiguous generally upright orientation whereas in the retracted condition said panels are withdrawn into closely adjacent stacked parallel inclined orientation at the top of said doorway;

at least the lowermost of said panels being free of attachment to any other panel and forming a detachable connection with its associated mountings so that when the doorway is partially or fully closed such panel is freed from its mountings when subjected to obstruction, or to loading of predetermined magnitude;

each said detachable connection having first release means operative in response to excessive loading applied to the panel in a direction normal to its plane, and second release means operative in response to loading applied to the panel in an uncoupling direction parallel to its plane and normal to its length.

2. A sectional door as claimed in claim 1 wherein each such detachable panel end is connected to its associated mounting by an interengaging projection-and-socket connection that comprises said first release means, said panel being sufficiently longitudinally flexible that under a predetermined force applied to a central region thereof in a direction normal to the plane of the panel it will deflect an amount sufficient to disengage said projection-and-socket connection, said panel having sufficient stiffness that the deflection produced by the panel's own weight when in the horizontal orientation will not effect such disengagement.

3. A sectional door as claimed in claim 2 wherein said second release means comprises a lateral opening in the socket of said projection-and-socket connection and through which the projection can be relatively displaced in said uncoupling direction.

4. A sectional door as claimed in claim 3 wherein each said detachable panel is disengageable in said uncoupling direction except when in or close to the deployed condition wherein such displacement is restricted by abutment between a lower panel and an adjacent upper panel.

5. A sectional door as claimed in claim 4 wherein lost motion is provided in said projection-and-socket connections to accommodate limited upwards displacement of each panel when in the deployed condition.

6. A sectional door as claimed in claim 2, wherein said operating mechanism comprises:

a scissors linkage engaged with each said vertical guideway and guided for vertical movement thereon, the scissors linkages being interconnected to move in unison during extension and retraction thereof;

actuating means coupled to and selectively operable to extend or retract said scissors linkages, one end of each scissors linkage being fixed near the upper end of its respective guideway.

7. A sectional door as claimed in claim 6 wherein the projection of each said projection-and-socket connection is carried on an associated pivot joint in a corresponding scissors linkage.

8. A sectional door as claimed in claim 7 wherein each said scissors linkage comprises a series of first parallel links interconnected to a series of second parallel links by pivot joints, each pivot joint passing horizontally through the mid points of a pair of corresponding first and second links, each first link being pivotally connected at its ends to the ends of adjacent second links and vice versa, such that said links pivot about said horizontal pivot joints as the linkages are extended or retracted, each said mounting being fixed with respect to an associated first link, and said linkages being in sliding engagement with said respective guideways.

9. A sectional door as claimed in claim 8 wherein each said guideway comprises a rigid post structure defining vertical engagement surfaces, said scissors linkage having bearing means contacting said engagement surfaces to move vertically thereon, said engagement surfaces having a substantial lateral extent in the horizontal direction to enhance resistance of the scissors linkages to horizontally directed bending moments that may be imparted by said panels.

10. A sectional door as claimed in claim 9 wherein said series of first parallel links and said series of second parallel links lie adjacent one side of said post structure in a vertical plane perpendicular to that of the doorway, third and fourth series of interconnected parallel links being positioned adjacent the opposite side of said post structure, the pivotal connections of all series being interconnected to move in unison.

11. A sectional door as claimed in claim 10 wherein said pivot joint of said first and second series are interconnected to the pivot joints of said third and fourth series by pivot pins that extend through and are guided for movement along a vertically extending slot that defines said engagement surfaces, said bearing means being carried by said pivot pins.

12. A sectional door as claimed in claim 11 wherein each said post structure comprises two channel members defining said vertically extending slot between opposed surfaces thereof each pivot pin carrying slide means for sliding engagement in said slot.

13. A sectional door as claimed in claim 12 wherein each said door panel is fabricated in plastics material and is generally planar in form, comprising two spaced sheets of transparent plastic separated by longitudinally extending reinforcing bars.

14. A sectional door as claimed in claim 13 wherein each said panel is fabricated in polycarbonate material, and said reinforcing bars are of fiberglass.

15. A sectional door as claimed in claim 11 wherein said slot is defined between parallel web surfaces of two channel members, said channel members each having spaced flange surfaces at right angles to the web surfaces, said flange surfaces being in sliding engagement with the links of said second and fourth series respectively.

16. A sectional door as claimed in claim 15 wherein friction reducing material is provided between said flange surfaces and said second and third series of links.

17. A panel for use in a sectional door installation, said panel being generally planar and configured at each end to form a yieldable attachment with a door operating mechanism to be disengageable therefrom when subjected to predetermined loading condition, such configuration being in the form of a socket adapted to receive a projection of a door operating mechanism, said socket being open in two directions at right angles to each other, one said direction being longitudinal of the panel and the other said direction being towards a lower edge of the panel, such that the projection can be inserted into and removed from the socket by relative movement in either of said directions.

18. A panel as claimed in claim 17 wherein said panel has flexibility sufficient to disengage from said projection when subjected to a bending moment of predetermined magnitude, while being stiff enough that its deflection under the force of gravity when oriented horizontally is not of sufficient magnitude as to disengage said attachment.

19. A panel as claimed in claim 18 comprising two spaced sheets of stiff transparent plastics material interconnected by longitudinally extending reinforcing means positioned therebetween.

20. A panel as claimed in claim 19 wherein said sheets are of discrete rectangular form, said reinforcing means comprising longitudinally extending rods to which said sheets are attached adjacent their upper and lower edges.

21. A panel as claimed in claim 19 wherein the outer of said two sheets has a projecting margin that extends below the lower edge of the inner of said two sheets.

22. A panel as claimed in claim 19 wherein said sheets are of polycarbonate material, said reinforcing means comprising longitudinally extending glass fibre rods, fastener means forming attachments between said sheets and said rods in a manner such as to accommodate differential expansion thereof.

23. A sectional door comprising:

a series of horizontal door panels each being connected at its opposite ends to an operating mechanism by means of which the door panels can be moved between a deployed condition, wherein they close a doorway, and a withdrawn condition, wherein the doorway is open, said operating mechanism comprising:

a pair of parallel vertical guideways for installation at opposite sides of the doorway and each having a series of mountings movable therealong;

each said door panel being generally planar, and having each of its opposite ends supported in a mounting of a corresponding one of said series, in the deployed condition said panels being arrayed in contiguous generally upright orientation whereas in the retracted condition said panels are withdrawn into closely adjacent included orientation at the top of said doorway;

each of said panels being detachable connected to its mounting so that when the doorway is partially or fully closed a panel can readily be displaced relative to its mountings when subjected to obstruction, or to loading of predetermined magnitude;

each said panel end being connected to its associated mounting by an interengaging projection-and-socket connection, said panel being sufficiently longitudinally flexible that under a predetermined force applied to a central region thereof in a direction normal to the plane of the panel it will deflect an amount sufficient to disengage said projection-and-socket connection, said panel having sufficient stiffness that the deflection produced by the panel's own weight when in the horizontal orientation will not effect such disengagement;

said panel being displaceable in the plane thereof in a direction normal to its length to disengage its projection-and-socket connections to its mounting means;

wherein each said panel comprises two spaced parallel sheets of stiff transparent plastics material spaced apart by and connected to longitudinally extending stiffening bars, the end portions of said sheets and bars defining the sockets of said projection-and-socket connection and said sockets being open towards the bottom of the panel.

24. A sectional door comprising:

a plurality of discrete horizontal door panels each being mounted at its opposite ends on an operating mechanism by means of which the door panels can be moved between a deployed condition wherein they close a doorway and a withdrawn condition wherein the doorwary is open, said panels being at all times parallel to each other, said operating mechanism comprising:

a pair of parallel vertical guideways for installation at opposite sides of the doorway and each having a series of mountings movable therealong;

each said door panel being generally planar, and having each of its opposite ends supported in a mounting of a corresponding one of said series, in the deployed condition said panels being arrayed in contiguos generally upright orientation whereas in the retracted condition said panels are withdrawn into closely adjacent stacked parallel orientation at the top of said doorway;

at least the lowermost of said panels being detachably connected to its mountings so that when the doorway is partially or fully closed such a panel is freed from its mountings when subjected to obstruction, or to loading of predetermined magnitude; the ends of such a detachable panel each being connected to its associated mounting by an interengaging projection-and-socket connection, the panel being sufficiently longitudinally flexible that under a predetermined force applied to a central region thereof in a direction normal to the plane of the panel it will deflect an amount sufficient to disengage said projection-and-socket connections, said panel having sufficient stiffness that the deflection produced by the panel's own weight when in the horizontal orientation will not effect such disengagement;

wherein each said detachable panel has end portions that define the sockets of said projection-and-socket connections said sockets being open towards the bottom of the panel, such detachable panel being displaceable in the plane thereof in a direction normal to its length to disengage its projection-and-socket connections by passage of the projections through the open bottoms of their associated sockets.

* * * * *